US007578350B2

(12) United States Patent
Cooper et al.

(10) Patent No.: US 7,578,350 B2
(45) Date of Patent: Aug. 25, 2009

(54) GAS MINIMIZATION IN RISER FOR WELL CONTROL EVENT

(75) Inventors: Iain Cooper, Sugar Land, TX (US); Walter Aldred, Thriplow (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 11/564,665

(22) Filed: Nov. 29, 2006

(65) Prior Publication Data

US 2008/0123470 A1 May 29, 2008

(51) Int. Cl.
*E21B 7/12* (2006.01)

(52) U.S. Cl. ..... 166/368; 166/367; 166/336; 166/373; 175/24; 702/189

(58) Field of Classification Search ..... 166/335, 166/350, 367, 368, 370, 373; 175/5–10; 702/127, 138, 140, 189
See application file for complete search history.

(56) References Cited

U.S. PATENT DOCUMENTS

| | | | | |
|---|---|---|---|---|
| 4,813,495 | A * | 3/1989 | Leach | 175/6 |
| 5,628,364 | A * | 5/1997 | Trenz | 166/53 |
| 6,250,391 | B1 * | 6/2001 | Proudfoot | 166/369 |
| 6,276,455 | B1 * | 8/2001 | Gonzalez | 166/357 |
| 6,536,522 | B2 * | 3/2003 | Birckhead et al. | 166/250.15 |
| 6,648,081 | B2 * | 11/2003 | Fincher et al. | 175/25 |
| 6,755,261 | B2 * | 6/2004 | Koederitz | 175/25 |
| 6,931,933 | B2 * | 8/2005 | Wilson | 73/706 |
| 7,032,658 | B2 * | 4/2006 | Chitwood et al. | 166/61 |
| 7,264,058 | B2 * | 9/2007 | Fossli | 166/367 |
| 7,318,343 | B2 * | 1/2008 | Coenen | 73/152.19 |
| 2004/0134662 | A1 * | 7/2004 | Chitwood et al. | 166/367 |
| 2004/0238177 | A1 * | 12/2004 | Fossli | 166/364 |
| 2006/0202122 | A1 * | 9/2006 | Gunn et al. | 250/339.13 |

FOREIGN PATENT DOCUMENTS

| | | | |
|---|---|---|---|
| GB | 2 415 047 | A | 12/2005 |
| WO | 2005121779 | A1 | 12/2005 |

OTHER PUBLICATIONS

"Schlumberger", Sedco Forex Well Control Manual, Jul. 10, 1999.

* cited by examiner

*Primary Examiner*—Thomas A Beach
*Assistant Examiner*—Matthew R Buck
(74) *Attorney, Agent, or Firm*—James McAleenan; Jody Lynn DeStefanis; Dale Gaudier

(57) ABSTRACT

A system for controlling gas in a subsea drilling operation is disclosed in one embodiment. The system includes a subsea blow-out preventer, riser coupled to the blow-out preventer, a gas sensor, a controller, and a signal pathway. The gas sensor is configured for placement below the riser and configured to contact wellbore fluids during normal drilling operation. The controller configured to automatically cause manipulation the blow-out preventer based upon information from the gas sensor. The signal pathway couples the gas sensor with the controller.

28 Claims, 3 Drawing Sheets

GAS MINIMIZATION IN RISER FOR WELL CONTROL EVENT

BACKGROUND

This disclosure relates in general to drilling wellbores through earth formations and, but not by way of limitation, to controlling gas in the wellbore fluid.

In deepwater drilling with a subsea blow-out preventer (BOP) there is risk of gas getting into the riser. Small amounts of gas may be undetected during the drilling process, particularly when drilling close to kick tolerance limits. Large expansion of gas in the drilling riser can occur to partially empty the riser. The volume of gas increases as it travels from the ocean floor toward the surface. Hydrostatic pressure can lead to riser collapse, the uncontrolled release of hydrocarbon at the surface when the diverter overloads or other problems.

In one embodiment of the invention, early kick detection is a consideration for rig safety and efficiency. The lower kick tolerances associated with deep water operations can be addressed by kick detection systems that are more sensitive and reliable that those which are usually available for conventional drilling operations. For example, lower fracture gradients than similar land or shallow water situations reduce the kick tolerance margin. However, kick detection in deepwater operations can be difficult. Two early warning signs of kicks are an increase in flow rate and pit volume. These signs are difficult to detect when drilling from floating vessels due to the nature of the drilling vessel motion. Waves can cause fluctuations in the pits that can complicate volume estimates. Similar problems affect the outflow rate measurement.

Failure to detect a gas influx lower in the wellbore in such an operation can lead to gas being circulated into a deepwater riser. This is even more likely when drilling with oil-based mud due to the solubility of the methane in the drilling fluid. Typically there is very limited pressure control at surface once the gas has been circulated past the BOP stack on the seafloor. The gas in the riser that is circulated during the drilling process can expand rapidly near surface and can lead to blow-out conditions. Furthermore, if the riser does become partially evacuated, there is also a risk of riser collapse.

When a kick is taken while drilling with a marine riser, there is a possibility that the gas can migrate or be circulated above the subsea BOP (SSBOP) stack. When this occurs, the choke and mud-gas separator are no longer available to control the flowrates when the riser gas reaches the surface. Even if the gas influx is detected early and the annular preventer is closed, some of gas influx may already be above the annular preventer. Additionally, there may be some gas above the annular preventer because detection of the kick did not occur until the gas had been circulated above the SSBOP stack.

An early flowcheck in the riser, immediately after shutting in the well, may show a flow indicating that the large bubbles are still rising. However, once all the small gas bubbles have been suspended in water based mud or dissolved in oil base mud, a flow check in the riser may falsely read negative even though there is gas in the riser. If a large amount of gas gets above the SSBOP stack, it can rise rapidly and carry a large volume of mud out of the riser at high rates. One way of managing gas in the riser is to avoid such situations.

SUMMARY

Gas influx detection is a consideration for rig safety and efficiency. One embodiment of the invention describes the placement of a sensitive methane sensor in the subsea blow-out preventer (BOP) below the lowest BOP circulation path.

The methane sensor is coupled, via an umbilical, to the surface rig control system to allow remote monitoring of methane. Other embodiments could monitor other gases in the BOP and report that information to surface. Detection of gas triggers an automated shut-in of the well that will minimize both the risk of human error during a highly stressful time and the volume of gas that could get in the riser. Quick detection of gas and remediation can keep the amount of gas released into the riser below an amount that can safely be handled by the diverter.

In one embodiment, the present disclosure provides a system for controlling gas in a subsea drilling operation. The system includes a subsea blow-out preventer, a riser coupled to the blow-out preventer, a gas sensor, a controller, and a signal pathway. The gas sensor is configured for placement below the riser and configured to contact wellbore fluids during normal drilling operation. The controller is configured to automatically cause manipulation of the subsea blow-out preventer based upon information from the gas sensor. The signal pathway couples the gas sensor to the controller.

In another embodiment, the present disclosure provides a method for controlling gas in subsea drilling. In one step, gas in wellbore fluid is detected before it passes the subsea blow-out preventer. A signal indicative of gas in the wellbore fluid below the riser is produced. Reaction to the signal is automatic and could include adjusting the subsea blow-out preventer.

In yet another embodiment, the present disclosure provides a method for remotely controlling gas in subsea drilling. In one step, a first signal indicative of gas in wellbore fluid is detected before the wellbore fluid passes a subsea blow-out preventer. If it is determined that the first signal indicates a level of gas above a predetermined threshold, a second signal is produced to command a subsea blow-out preventer to perform one or more adjustments.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment (s) will provide those skilled in the art with an enabling description for implementing a preferred exemplary embodiment. It being understood that various changes may be made in the function and arrangement of elements without departing from the spirit and scope as set forth in the appended claims.

Figure 1:
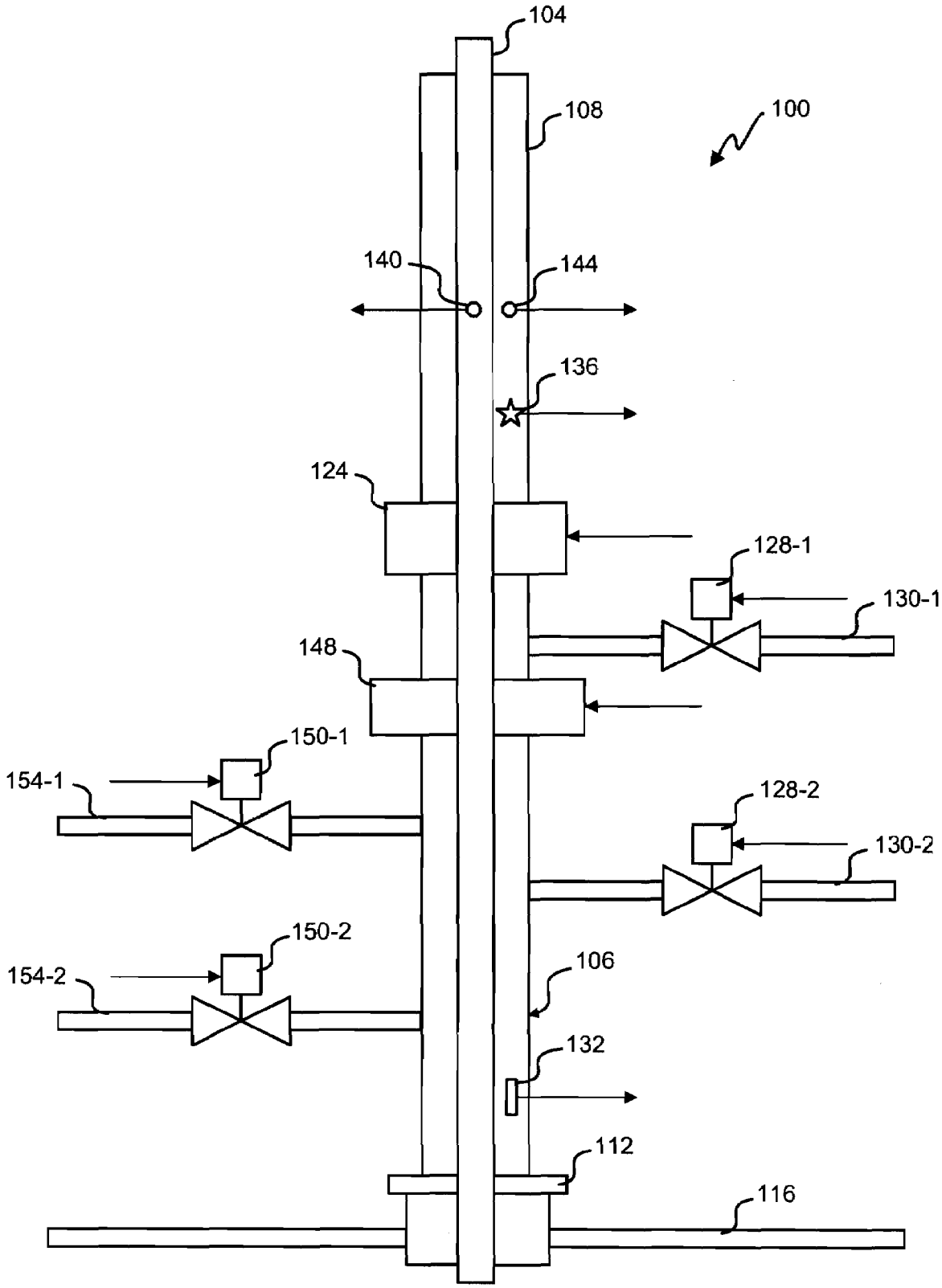
FIG. 1 depicts a diagram of an embodiment of subsea drilling equipment.

Referring first to FIG. 1, a diagram of an embodiment of subsea drilling equipment 100 is shown. A drill string 104 extends through a riser 108 and into the wellbore. The wellbore passes down from the seabed 116. The beginning of the wellbore is reinforced by a casing head 112. An umbilical (not shown) is used to pass electrical signaling between the platform (not shown) and the a blow-out preventer (BOP) 106. Additionally, kill and choke lines 154, 130 pass along the riser 108 to the surface.

Drilling fluid passes down the drill string 104 and returns to the surface through the riser 108. There are various components in a BOP 106 to control this process. An annular preventer 124 seals the annular space and can be remotely controlled as denoted by the arrow. Pipe and/or shear ram(s) 148 are respectively used to either hold the drill string in place, provide additional blow-out prevention or cut through the drill string 104. Some embodiments could have multiple BOPs 106, called a BOP stack.

This embodiment has two kill lines 154 and two choke lines 130 in the BOP 106. The kill lines 154 each have an electrically controlled valve 150. Similarly, the choke lines 130 each have a choke valve 128 that is controllable remotely. The choke and kill lines 130, 154 can be manipulated to control the circulation of wellbore fluids under pressure in the event of a well control incident.

A methane detector 132 could be based on either electrochemical or optical principles More specifically, in-situ real-time detection of methane can be achieved using an electrochemical sensor with a metal oxide compound immobilized onto an electrode surface, mimicking the catalytic center of the enzyme methane monooxygenase (MMO), which catalyses the partial oxidative conversion of methane into methanol. This methane gas sensor 132 produces a current from the reaction rate or turnover of the methane conversion that corresponds to the concentration of the target molecule(s) and can be recorded remotely.

The methane gas sensor 132 could be placed anywhere in the BOP or the wellbore to detect gas in the drilling fluid as it returns to the surface. In the depicted embodiment, the methane gas sensor 132 is placed below the lowest kill line in the subsea BOP. The methane gas or other light hydrocarbon molecules get into the drilling fluid from the formation during a kick situation. The kick is physically caused by the pressure in the wellbore being less than that of the formation fluids.

When controlling gas in the subsea drilling equipment 100, other sensors may be used. This embodiment includes a drillpipe pressure sensor 140 to measure pressure in the drilling fluid as it passes through the drill string 104. On the return of the drilling fluid and cuttings in the riser 108 an annulus pressure sensor 144 is used. The flow in the annulus of the riser 108 is measured with a riser flow meter 136.

Figure 2:
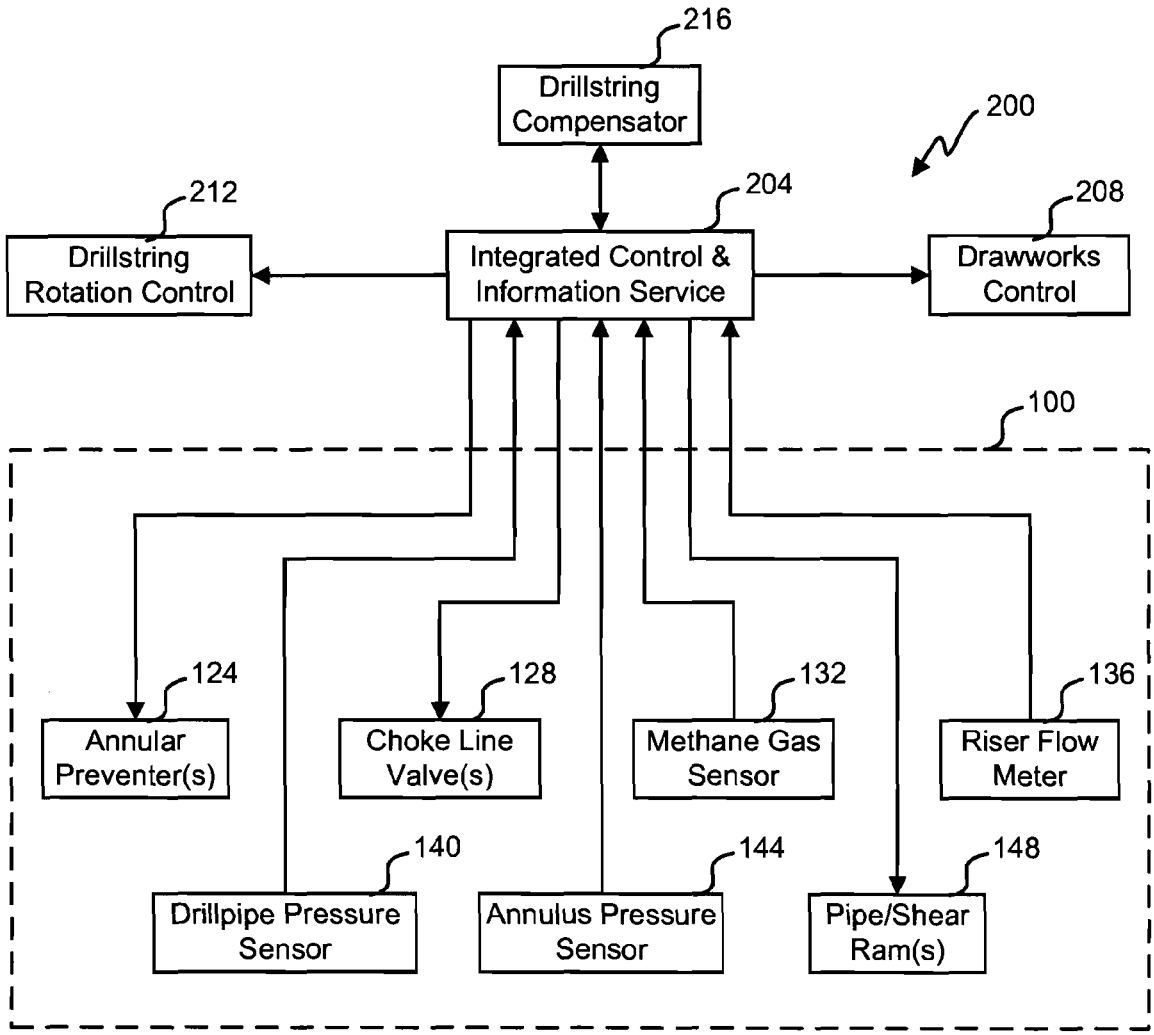
FIG. 2 depicts a block diagram of an embodiment of a drilling system.

With reference to FIG. 2, a block diagram of an embodiment of a drilling system 200 is shown. The blocks associated with the subsea drilling equipment 100 are shown with the dashed rectangle. The subsea drilling equipment 100 includes functional blocks for the annular preventer(s) 124, the choke lines valve(s) 128, the methane gas sensor 132, the riser flow meter 136, the drillpipe pressure sensor 140, the annulus pressure sensor 144, and the pipe and/or shear ram(s) 148.

One embodiment of the invention uses an integrated control and information service (ICIS) 204. For example, a Varco™ V-ICIS system that controls the subsea drilling equipment 100, pumps, drillstring compensation 216, block position, and drillstring rotation speed could be used. The drillstring rotation control 212 could be a rotary table or a top drive in various embodiments that is controlled by the ICIS 204. The Varco™ V-ICIS is one of the commercially available platforms for rig floor integration control and automation. It is designed for both offshore and land rig operations, and allows rig floor operators to focus on strategic drilling operations, rather than manual equipment operation.

Through various controls and measurements, the V-ICIS can automatically perform many tasks. V-ICIS integrates the control of the following drilling systems using joysticks and touch screens for operator interface: automated drilling equipment, top drives, pipe handling equipment, iron roughnecks, pressure control, annular preventer 124, pipe/shear ram(s) 148, kill lines 154, choke lines and valves 130, 128, diverters, automated mud systems, automated fluid transfer systems, automated mud chemical dosing systems, shaker load control systems, drawworks 208, SCR controls, drillstring compensator 216, drilling information systems, bulk tank control systems, and/or customer defined controls and interfaces. The V-ICIS also gathers information to aid in decision-making, for example, a drillpipe pressure sensor 140, an annulus pressure sensor 144, a riser flow meter 136, and/or a methane gas sensor 132 could be used in various embodiments.

Such a drilling system 200 can be tailored to piece together in an automated manner the sequence of events to safely stop circulation and shut the well in once gas has been detected in the riser when combined with the novel methane gas sensor 132. The sequence is tailored for the total number of BOPs in the stack and configuration of each BOP 126. Further, the drilling system 200 can mitigate the gas before it damages the riser or platform. The ICIS 204 can be implemented with a computing device with software and/or hardware.

Figure 3:
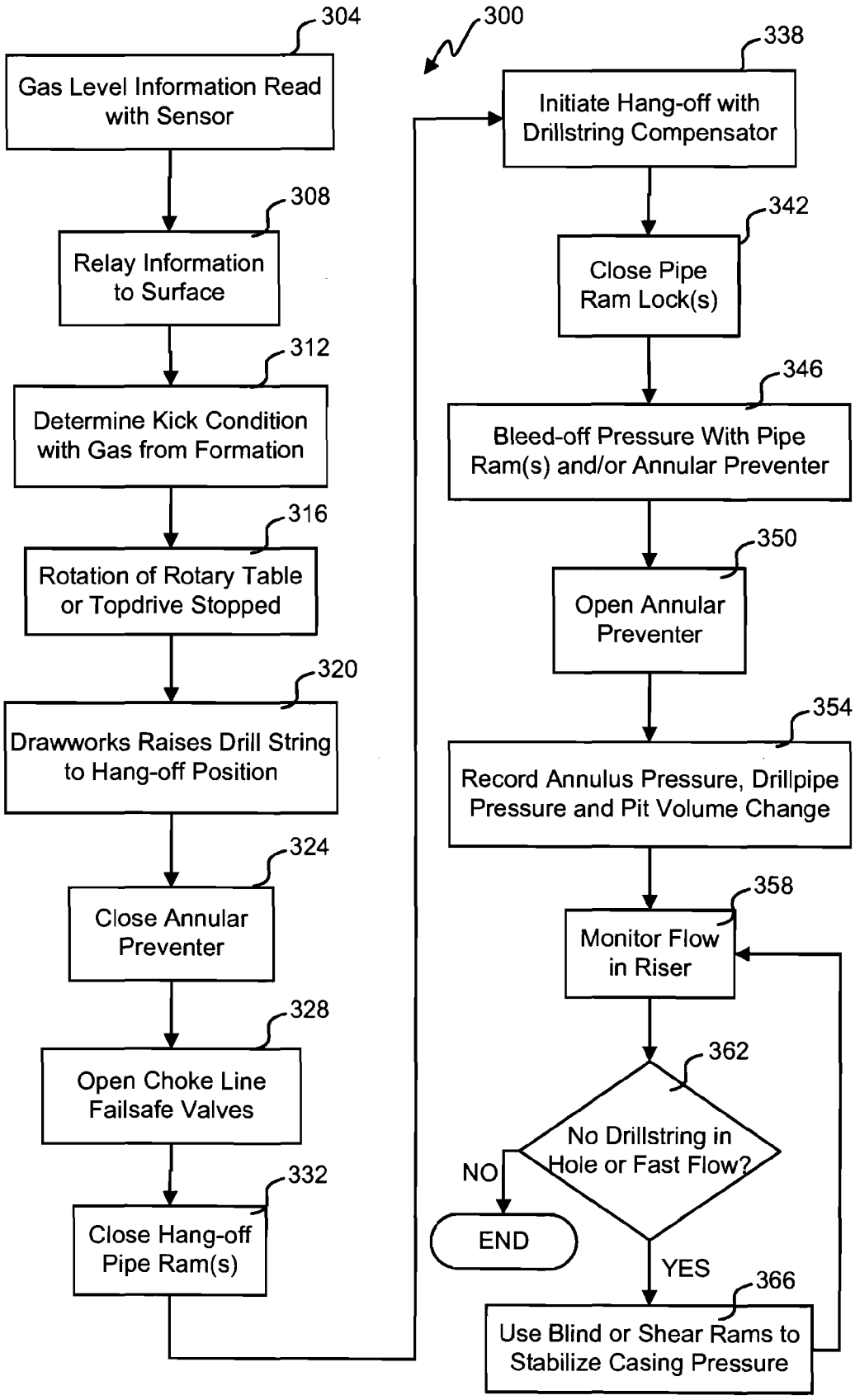
FIG. 3 illustrates a flowchart of an embodiment of a process for controlling gas in subsea drilling.

Referring next to FIG. 3, a flowchart of an embodiment of a process 300 for controlling gas in subsea drilling is illustrated. Once the methane gas has been detected by the sensor 132, via an umbilical connection to the V-ICIS system 204, the following sequence of events can be automated while drilling. Similar procedures can be followed while tripping, while out of hole, etc. The ICIS 204 controls the process, but allows manual disable. The depicted portion of the process 300 begins in step 304 where gas level information is read from the methane sensor 132. These readings could happen continuously or at a predetermined interval. Other embodiments only report gas levels above a threshold as an alarm. In any event, gas level information is relayed to the ICIS 204 in step 308.

It is determined in step 312 if a kick condition exists by measurement of the gas in the drilling fluid. The driller may be flagged that gas has been or is about to be circulated into the riser 108 so that he or she is aware that control of the rig equipment is being taken over by the ICIS 204 (there is a manual override if necessary). In step 316, the ICIS 204 sends a command to the rotary table or top drive to stop rotation of the drillstring 104. The ICIS 204 sends a command to the drawworks control 208 to raise the drillstring 104 to the hang-off position in step 320. A command to close annular preventer or top preventer and open choke line failsafe valves 128 in steps 324 and 328.

The ICIS 204 is aware the pipe locations so it can then check the space out and close the hang-off pipe rams 148 at the appropriate location in step 332. The ICIS 204 sends a command to hang-off, use the drillstring compensator 212 in step 338 and close the pipe ram locks in step 342. The pressure in the BOP 106 can then be bled off between the pipe rams 148 and the annular preventer 124 in a controlled manner by the ICIS 204. Once the pressure is bled-off, the annular preventer 124 is opened in step 350.

The annulus and drillpipe pressures are read from the pressure sensors 144, 140 and the pit volume change is determined in step 354. The riser flow meter 136 is read in step 358. If there is no drillstring in the hole and/or the flow in the riser 108 is fast as determined in step 362, blind and/or shear rams 148 may be used by the ICIS 204 in step 366 before the stabilized casing pressure is noted. After stabilization, the riser 108 is then monitored for flow again in step 358.

If the volume of gas above the BOP 106 or BOP stack is kept small by detection equipment and shut-in, the gas can be safely handled at surface by allowing the gas bubbles to disperse and/or controlling the rate at which gas is brought to the surface. The controlled rate of gas could flow through the riser boost line if the annular preventer is closed during a well control event in the main borehole. Small amounts of gas in the riser 108 can be mitigated with a riser gas handler below the slip joint and/or with a diverter at surface, which can give sufficient back pressure to control the flowrate. Should the gas surface, it may do so rapidly and at a high rate with little warning without early detection of the gas.

If there is gas in the riser 108 and a significant amount of gas in the main wellbore, simultaneous riser and well killing is performed in one embodiment. This is a complex procedure and can split the attention of the operations personnel leading to oversight or error when done manually. Automation of the riser gas handling reduces such a risk, by focusing attention on well-established primary well control techniques for the main wellbore in a process controlled by the ICIS 204. International Association of Drilling Contractors (IADC) well control procedures for deep water recommend that personnel be minimized on the rig floor when there is gas in the riser due to the severity of the risk. Methane gas detection and rig automation is another way of ensuring minimum risk of exposure of rig personnel to hazardous situations.

A number of variations and modifications of the disclosed embodiments can also be used. For example, the above embodiments show a single gas sensor, but other embodiments could have a plurality of gas sensors. The multiple gas sensors could be located in various locations in the BOP or within the casing.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, and/or a combination thereof.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

Moreover, as disclosed herein, the term "storage medium" may represent one or more memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, wireless channels, and/or various other storage mediums capable of storing that contain or carry instruction (s) and/or data.

While the principles of the disclosure have been described above in connection with specific apparatuses and methods, it is to be clearly understood that this description is made only by way of example and not as limitation on the scope of the disclosure.

What is claimed is:

1. A system for controlling gas in a subsea drilling operation, the system comprising:

a wellbore extending below the sea bed;

a subsea blow-out preventer coupled to the wellbore;

a riser coupled to the subsea blow-out preventer, said riser, wellbore and blow-out preventer enclosing a pathway through and below the sea bed;

a drillstring extending through said pathway, surrounded therein by an annular space, the blow-out preventer being configured to seal the annular space at a point of closure below the riser;

a gas sensor located at a position within said pathway below said point of closure and exteriorly of said drillstring, such that the sensor is positioned and configured to contact wellbore fluids which have ascended within said annular space during normal drilling operation but have not yet passed the point of closure, said gas sensor being effective to detect the presence of gas in the wellbore fluid which it contacts;

a controller configured to automatically cause manipulation of the subsea blow-out preventer based upon information from the gas sensor, and a signal pathway which couples the gas sensor with the controller.

2. The system for controlling gas in the subsea drilling operation as recited in claim 1, wherein the gas sensor is configured to detect light hydrocarbon molecules.

3. The system for controlling gas in the subsea drilling operation as recited in claim 1, wherein the controller is above sea.

4. The system for controlling gas in the subsea drilling operation as recited in claim 1, wherein the gas sensor is configured to detect methane.

5. The system for controlling gas in the subsea drilling operation as recited in claim 1, wherein the gas sensor is an electro-chemical sensor that produces an electrical signal when the gas sensor is in contact with gas in the wellbore fluid.

6. The system for controlling gas in the subsea drilling operation as recited in claim 1, wherein the gas sensor is within the borehole.

7. The system for controlling gas in the subsea drilling operation as recited in claim 1, wherein:

the blow-out preventer comprises one or more kill lines, and the gas sensor is located between the one or more kill lines and the wellbore.

8. The system for controlling gas in the subsea drilling operation as recited in claim 1, wherein:

the subsea blow-out preventer comprises a circulation path, and the gas sensor is located between the circulation path and the drilling bit.

9. A method for controlling gas in subsea drilling, the method comprising steps of:

providing a subsea blow-out preventer coupled to a wellbore extending below the sea bed, and a riser coupled to the subsea blow-out preventer, said riser, wellbore and blow-out preventer enclosing a pathway through and below the sea bed;

providing a drillstring extending through said pathway, surrounded therein by an annular space, the blow-out preventer being configured to seal the annular space at a point of closure below the riser;

also providing a gas sensor located at a position within said pathway below said point of closure and exteriorly of said drillstring, such that the sensor is positioned and configured to contact wellbore fluids which have ascended in said annular space during normal drilling operation before said fluids pass the point of closure;

thereby detecting the presence of gas in welibore fluid before said fluid passes the subsea blow-out preventer and enters the riser;

producing a signal indicative of the detected gas in the wellbore fluid; and automatically reacting to the signal, wherein the reacting step comprises a sub-step of adjusting the subsea blow-out preventer.

10. The method for controlling gas in subsea drilling as recited in claim 9, further comprising a step of determining that the signal indicates the presence of gas at a level above a predetermined threshold.

11. The method for controlling gas in subsea drilling as recited in claim 9, wherein the adjusting sub-step comprises a step of manipulating a ram to control flow of wellbore fluid.

12. The method for controlling gas in subsea drilling as recited in claim 9, further comprising a step of receiving the signal above sea level.

13. The method for controlling gas in subsea drilling as recited in claim 9, wherein the adjusting sub-step comprises a step of opening the annular preventer.

14. The method for controlling gas in subsea drilling as recited in claim 9, wherein the adjusting sub-step comprises a step of bleeding off pressure with the subsea blow-out preventer.

15. A system adapted to perform the machine-implementable method for controlling gas in subsea drilling of claim 9.

16. A method for remotely controlling gas in subsea drilling, the method comprising steps of:

providing a subsea blow-out preventer coupled to a wellbore extending below the sea bed, and a riser coupled to the subsea blow-out preventer, said riser, wellbore and blow-out preventer enclosing a pathway through and below the sea bed;

providing a drillstring extending through said pathway, surrounded therein by an annular space, the blow-out preventer being configured to seal the annular space at a point of closure below the riser;

also providing a gas sensor located at a position within said pathway below said point of closure and exteriorly of said drillstring, such that the sensor is positioned and configured to contact wellbore fluids which have ascended in said annular space during normal drilling operation before said fluids pass the point of closure;

receiving a first signal from said sensor indicative of gas present in wellbore fluid before the wellbore fluid passes the subsea blow-out preventer;

determining that the first signal indicates a level of gas above a predetermined threshold; and automatically reacting to such determination by producing a second signal commanding a subsea blow-out preventer to perform one or more adjustments based upon an outcome of the determining step.

17. The method for remotely controlling gas in subsea drilling as recited in claim 16, wherein the one or more adjustments includes a step of opening choke lines.

18. The method for remotely controlling gas in subsea drilling as recited in claim 16, wherein the determining step is performed proximate to the blow-out preventer.

19. The method for remotely controlling gas in subsea drilling as recited in claim 16, wherein the one or more adjustments includes a step of opening the annular preventer.

20. The method for remotely controlling gas in subsea drilling as recited in claim 16, wherein the one or more adjustments includes a step of bleeding off pressure with the subsea blow-out preventer.

21. A machine-readable medium having machine-executable instructions configured to cause performance of the machine-implementable method for remotely controlling gas in subsea drilling of claim 16.

22. The system for controlling gas in the subsea drilling operation as recited in claim 1, comprising means to determine whether the level of gas detected by said sensor exceeds a predetermined threshold.

23. The method for controlling gas in subsea drilling as recited in claim 9, wherein the gas is light hydrocarbon.

24. The method for remotely controlling gas in subsea drilling as recited in claim 16, wherein the gas is light hydrocarbon.

25. A system for controlling gas in a subsea drilling operation, the system comprising:

a wellbore with a casing extending below the sea bed;

a subsea blow-out preventer coupled to the wellbore;

a riser coupled to the subsea blow-out preventer, said riser, wellbore casing and blow-out preventer enclosing a pathway through and below the sea bed, the blow-out preventer being configured to close the pathway at a point below the riser;

a gas sensor configured for placement below the riser and located in one of said casing and said blow-out preventer below said point of closure, such that the sensor is positioned and configured to contact wellbore fluids which have ascended the wellbore during normal drilling operation before said fluids pass the point of closure, said gas sensor being effective to detect the presence of gas in the wellbore fluid which it contacts;

a controller configured to automatically cause manipulation of the subsea blow-out preventer based upon information from the gas sensor, and a signal pathway which couples the gas sensor with the controller.

26. The system for controlling gas in the subsea drilling operation as recited in claim 25, wherein the gas sensor is an electro-chemical sensor that produces an electrical signal when the gas sensor is in contact with gas in the wellbore fluid.

27. The system for controlling gas in the subsea drilling operation as recited in claim 1 wherein the gas sensor is located in the blow-out preventer below said point of closure.

28. The system for controlling gas in the subsea drilling operation as recited in claim 1 wherein the wellbore has a casing and the gas sensor is located in the casing, proximate the blow-out preventer.

* * * * *